US010293267B2

(12) United States Patent
Rehkemper et al.

(10) Patent No.: US 10,293,267 B2
(45) Date of Patent: May 21, 2019

(54) BATTLE SYSTEM FOR TOY CHARACTERS INCLUDING AN EXPANDABLE HOUSING

(71) Applicant: Rehco, LLC, Chicago, IL (US)

(72) Inventors: Steven Rehkemper, Chicago, IL (US); Adam Gelder, Oak Lawn, IL (US)

(73) Assignee: Rehco, LLC, Chicago, IL (US)

( * ) Notice: Subject to any disclaimer, the term of this patent is extended or adjusted under 35 U.S.C. 154(b) by 0 days.

(21) Appl. No.: 15/639,284

(22) Filed: Jun. 30, 2017

(65) Prior Publication Data

US 2018/0008901 A1 Jan. 11, 2018

Related U.S. Application Data

(60) Provisional application No. 62/359,276, filed on Jul. 7, 2016.

(51) Int. Cl.

| | |
|---|---|
| ***A63H 33/00*** | (2006.01) |
| ***A63H 27/10*** | (2006.01) |
| ***A63H 3/06*** | (2006.01) |
| ***A63H 13/06*** | (2006.01) |

(52) U.S. Cl.

CPC ..... *A63H 33/00* (2013.01); *A63H 3/06* (2013.01); *A63H 13/06* (2013.01); *A63H 27/10* (2013.01); *A63H 2027/1041* (2013.01)

(58) Field of Classification Search

CPC ..... A63H 27/10; A63H 13/04; A63H 13/06; A63F 2009/0084; A63B 19/00

See application file for complete search history.

(56) References Cited

U.S. PATENT DOCUMENTS

| | | | | | |
|---|---|---|---|---|---|
| 1,554,050 | A | * | 9/1925 | Slye | A63H 27/10 446/223 |
| 1,612,643 | A | * | 12/1926 | Mulholland | A63H 27/10 446/223 |
| 1,858,460 | A | * | 5/1932 | Ranseen | A63H 27/10 40/214 |
| 2,856,732 | A | * | 10/1958 | Weismantel | A63H 37/00 446/14 |
| 3,092,388 | A | * | 6/1963 | Wagenheim | A63F 9/0204 273/380 |
| 3,204,369 | A | * | 9/1965 | Green | A63H 5/00 273/DIG. 25 |

(Continued)

*Primary Examiner* — John E Simms, Jr.
*Assistant Examiner* — Urszula M Cegielnik
(74) *Attorney, Agent, or Firm* — Adam K. Sacharoff; Much Shelist, P.C.

(57) ABSTRACT

A support structure for a toy character including a base, an expandable housing, a cap assembly, and at least one appendage is provided. The cap assembly includes at least two straps and a band for securing the cap assembly to the expandable housing. The at least one appendage extends from the cap assembly and includes a puncture surface. A rotation mechanism may be mounted to the base and have a receiving aperture sized to receive a portion of the expandable housing and include a lever to direct rotation of the rotation mechanism. The rotation mechanism may further include a rotation member having one or more hooks located adjacent the receiving aperture for securing the expandable housing thereto. The rotation member may be removeable from the base to provide access to the one or more hooks.

8 Claims, 7 Drawing Sheets

(56) References Cited

U.S. PATENT DOCUMENTS 3,370,853 A * 2/1968 Feld ..... A63B 43/005 119/850
3,608,903 A * 9/1971 Cooper ..... A63F 9/0079 273/236
3,685,825 A * 8/1972 Dorazio ..... A63F 9/0079 273/138.1
3,795,400 A * 3/1974 Glass ..... A63F 9/0079 273/450
3,848,357 A * 11/1974 Morrison ..... A63H 13/06 273/440.1
3,861,684 A * 1/1975 Gastin ..... A63F 9/0079 273/243
4,113,261 A * 9/1978 Sims ..... A63F 3/00148 273/249
4,169,593 A * 10/1979 Wood ..... A63F 9/0079 273/138.1
4,319,751 A * 3/1982 Kurushima ..... A63H 13/06 273/440.1
4,367,875 A * 1/1983 Barlow ..... A63H 13/06 273/384
4,453,711 A * 6/1984 Gin ..... A63F 9/0079 273/445
4,538,817 A * 9/1985 Ramella ..... A63F 9/0204 273/380
4,881,733 A * 11/1989 Rehkemper ..... A63F 9/0079 273/138.1
4,900,020 A * 2/1990 Rehkemper ..... A63F 9/0079 273/458
5,042,807 A * 8/1991 Sasakawa ..... A63F 9/0079 273/440.1
5,046,983 A * 9/1991 Suzuki ..... A63H 13/02 446/158
5,123,869 A * 6/1992 Schipmann ..... A63H 33/18 446/225
5,256,099 A * 10/1993 Rudell ..... A63H 33/009 401/148
5,380,234 A * 1/1995 Ledford ..... A63H 3/06 273/440.1
5,458,523 A * 10/1995 Aoki ..... A63F 7/2409 273/440.1
5,527,222 A * 6/1996 Demita ..... A63H 37/00 446/220
5,732,953 A * 3/1998 Tamura ..... A63F 7/2409 273/440.1
5,839,981 A * 11/1998 Rudell ..... A63B 63/083 273/384
6,402,582 B1 * 6/2002 Sherer ..... A63H 27/10 273/138.1
7,481,727 B2 * 1/2009 Chia ..... A63B 43/00 473/577
7,934,973 B2 * 5/2011 Trageser ..... A63H 3/46 446/180
9,254,444 B1 * 2/2016 Toomey ..... A63H 27/10
2002/0155783 A1 * 10/2002 Chan ..... A63H 13/06 446/335
2005/0075176 A1 * 4/2005 De Vogel ..... A63H 13/20 472/57
2008/0023913 A1 * 1/2008 Barthold ..... A63F 3/00 273/241
2010/0267309 A1 * 10/2010 Hyland ..... A63F 9/0079 446/188
2011/0177749 A1 * 7/2011 Zuloff ..... A63F 5/04 446/220
2013/0008064 A1 * 1/2013 Park ..... G09F 15/0025 40/603

* cited by examiner

BATTLE SYSTEM FOR TOY CHARACTERS INCLUDING AN EXPANDABLE HOUSING

CROSS-REFERENCE TO RELATED APPLICATION

This application claims the benefit of U.S. provisional application Ser. No. 62/359,276 filed Jul. 7, 2016, the disclosure of which is hereby incorporated in its entirety by reference herein.

TECHNICAL FIELD

The present disclosure relates to a battle system for toy character assemblies including an inflatable housing.

BACKGROUND

Toys and games with fighting or punching play patterns include several classic toy and game products that embody battling play. Some games have heads that spring up or off and many other variations of the same idea are also used.

SUMMARY

A support structure for a toy character may include a base, an actuator, an inflatable housing, and a retainer. The actuator may be mounted to the base movement. The retainer may be sized to cooperate with the inflatable housing. At least one movable appendage is provided.

A toy character battle system may include a first character assembly and a second character assembly. The first character assembly may include a first inflatable housing mounted to a first base. The first base may include a rotation mechanism to direct rotation of the first inflatable housing and a first cap member mounted to the housing including a first appendage with a first puncture surface. The second character assembly may include a second inflatable housing mounted to a second base. The second base may include a rotation mechanism to direct rotation of the second inflatable housing and a second cap member mounted to the housing including a second appendage with a second puncture surface.

A method of play for a toy character battle system may provide first and second toy character assemblies each including an inflatable housing, at least one appendage with a puncture surface, and a rotation mechanism to move the at least one appendage. The method may also include directing users to position the toy character assemblies proximate one another such that the puncture surfaces are within range of contacting the opposing inflatable housing. The method may further include directing the users to commence a battle between the first and second toy character assemblies until one of the inflatable housings is punctured via one of the puncture surfaces.

A support structure for a toy character includes a base, an expandable housing, a cap assembly, and at least one appendage. The cap assembly includes at least two straps and a band for securing the cap assembly to the expandable housing. The at least one appendage extends from the cap assembly and includes a puncture surface. A rotation mechanism may be mounted to the base and have a receiving aperture sized to receive a portion of the expandable housing and include a lever to direct rotation of the rotation mechanism. The rotation mechanism may further include a rotation member having one or more hooks located adjacent the receiving aperture for securing the expandable housing thereto. The rotation member may be removeable from the base to provide access to the one or more hooks. The rotation mechanism may include a rotation housing to support the rotation member and define a first rack. The lever may define a second rack sized to mesh with the first rack so that movement of the second rack directs rotation of the rotation housing to rotate the expandable housing. The puncture surface may be at least one of a sand paper segment, an emery board, a silica-based grit, an aluminum based grit, a breakaway lancet, a pin, and a portion of gnarled metal. The puncture surface may be a strip of material extending through two slots defined by the at least one appendage. The band may be expandable to accommodate more than one size of the expandable housing. An indicia member may extend from the cap assembly and include a surface sized for displaying indicia. A toy character battle system may include the support structure for the toy character and a second support structure for another toy character including a second expandable housing and a second puncture surface located upon a second appendage extending from a second cap assembly. The support structure and the second support structure may be arranged with one another for a sparring sequence in which each of the support structure and the second support structure are rotated until one of the puncture surfaces punctures one of the expandable housings. The base and cap assembly may be stylized to have one of a medieval theme, an animal theme, a robot theme, and an alien theme.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ embodiments of the present disclosure. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
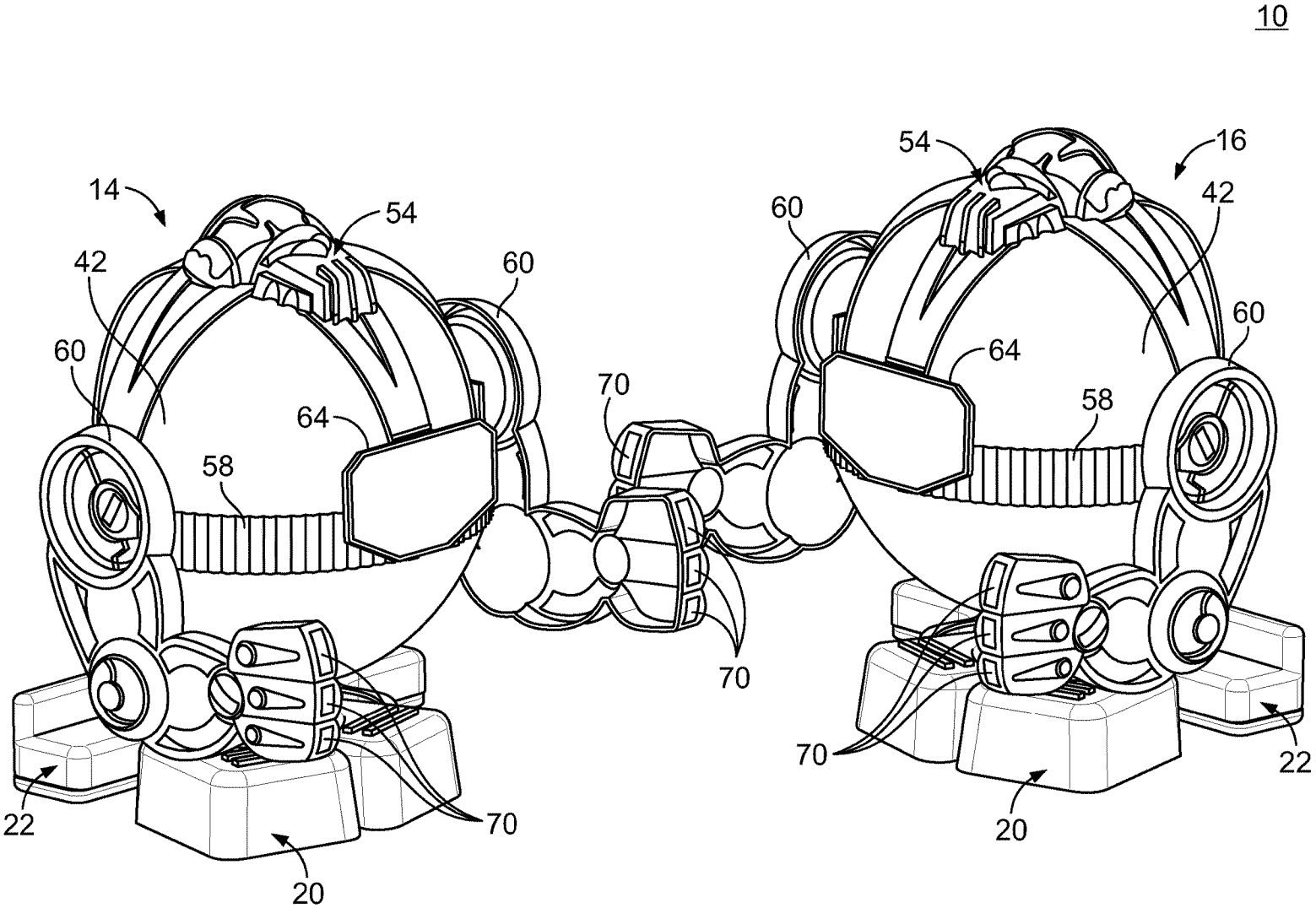
FIG. 1 is a perspective view of an example of first and second toy characters of a battle system.

In a battle-oriented toy or game, a winner may be easily and dramatically obvious to players at the end of the competition. FIG. 1 shows an example of a battle system for toy characters referred to generally as a system 10 herein. The system 10 includes a first toy character 14 and a second toy character 16. Users may position the toy characters on an underlying surface for battle with one another. For example, the first toy character 14 and the second toy character 16 may battle with one another to puncture or pop the opposing character's inflatable housing as further described herein.

Figure 3:
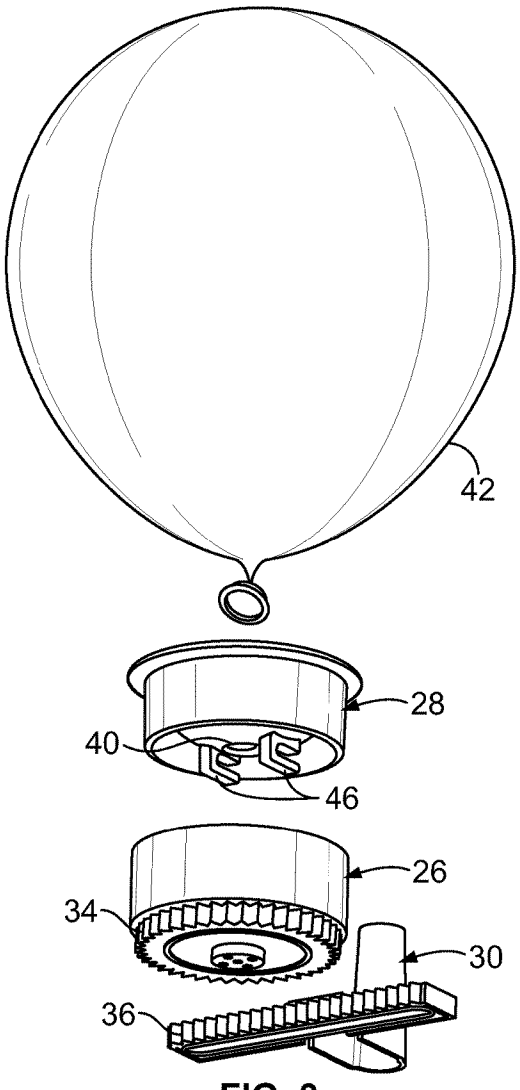
FIG. 3 is an exploded view of a portion of the structural elements of FIG. 2 and a balloon.
Figure 2:
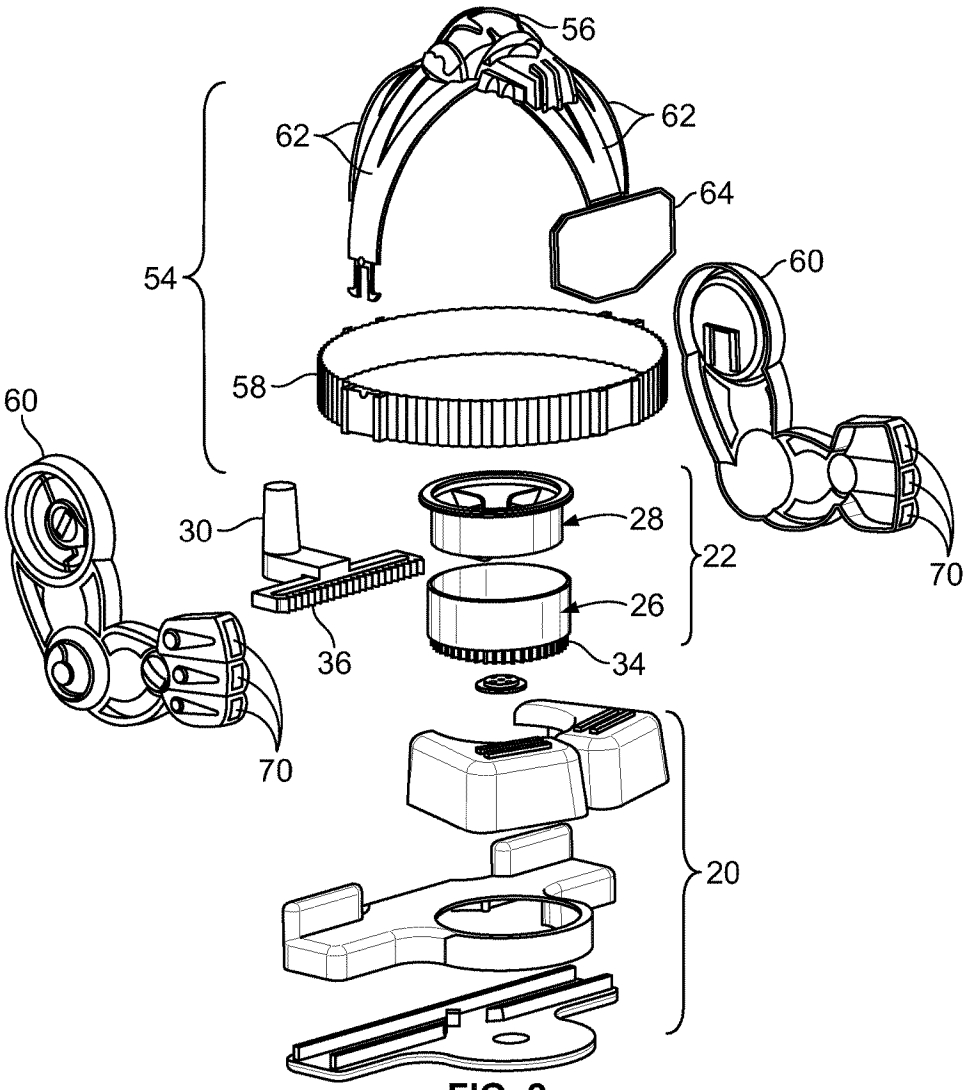
FIG. 2 is an exploded view of an example of structural elements of each of the first and second toy characters of FIG. 1.
Figure 5:
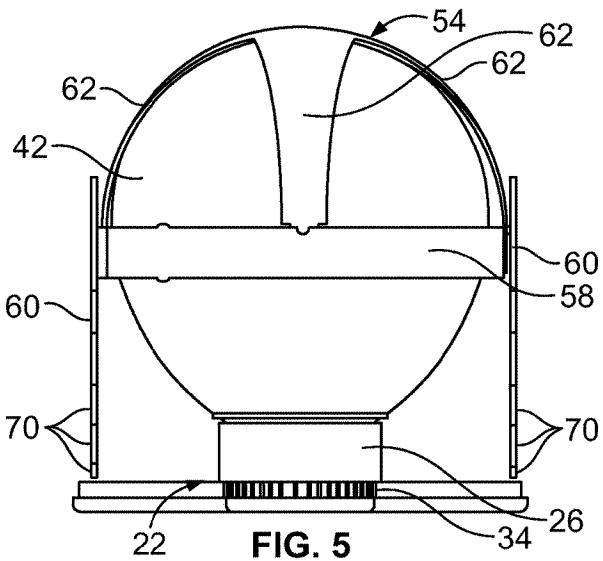
FIG. 5 is a front view of the toy character of FIG. 4.
Figure 6:
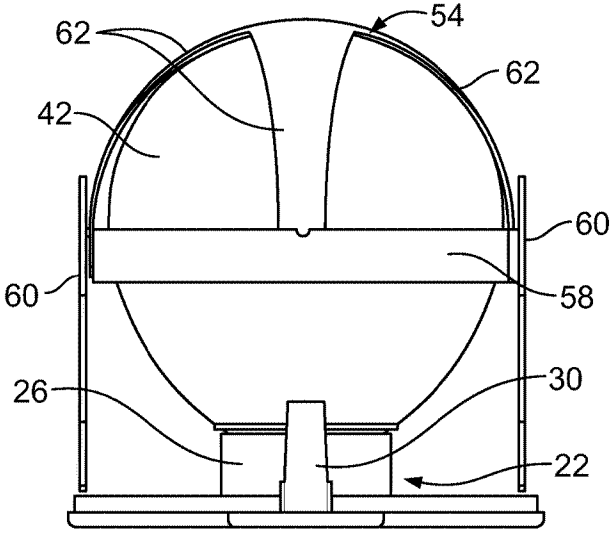
FIG. 6 is a rear view of the toy character of FIG. 4.
Figure 4:
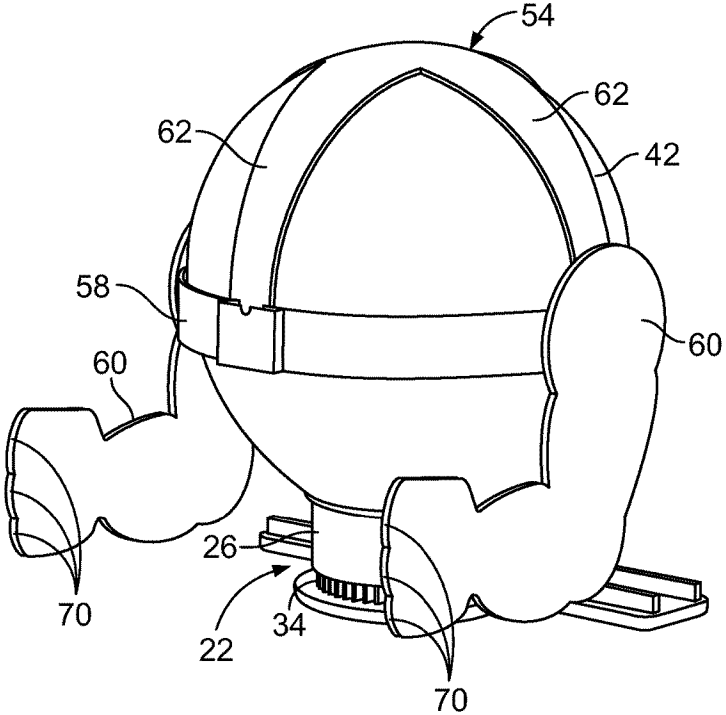
FIG. 4 is a perspective view of one of the toy characters of FIG. 1.
Figure 8:
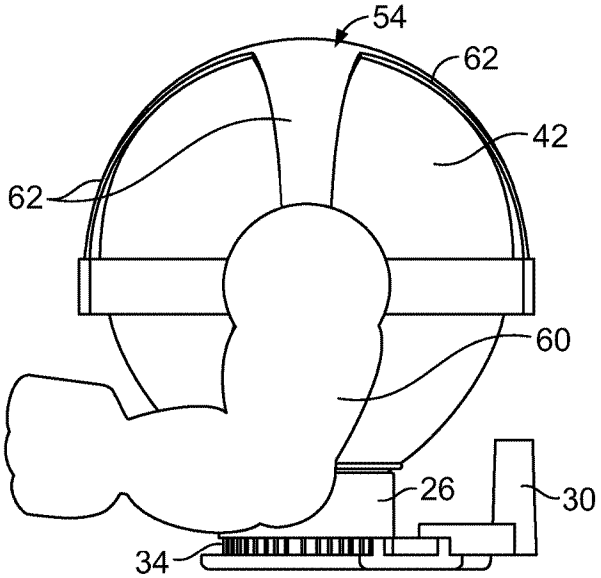
FIG. 8 is a second side view of the toy character of FIG. 4.
Figure 7:
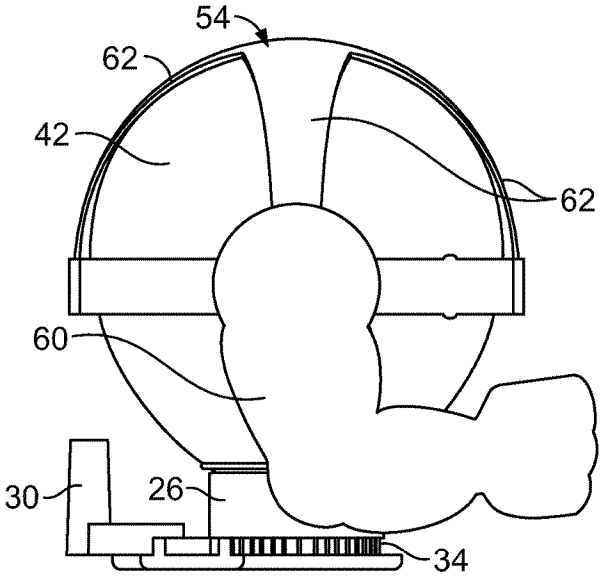
FIG. 7 is a first side view of the toy character of FIG. 4.
Figure 9:
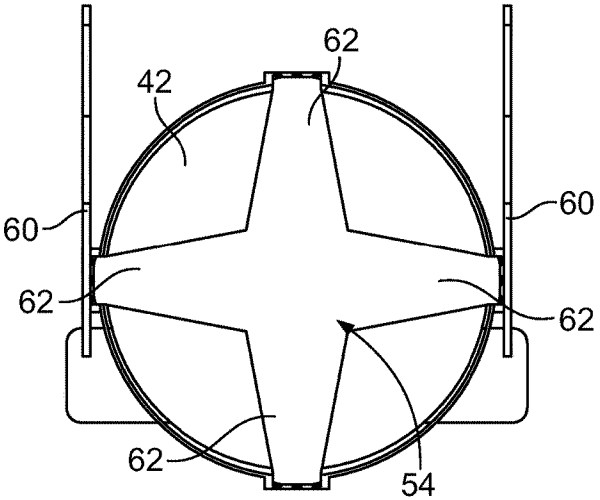
FIG. 9 is a top view of the toy character of FIG. 4.

FIGS. 2 and 3 show an example of a structure for an assembly of each of the toy characters 14 and 16. FIGS. 4 through 9 depict multiple views of the assembly for each of the toy characters 14 and 16 with a housing of a base 20 removed and with portions of a cap assembly removed to show internal components. The first toy character 14 and the second toy character 16 may each include the base 20 and a rotation mechanism 22. The rotation mechanism 22 may be mounted for rotation to the base 20 and include a cylinder 26 defining a cavity sized to receive a rotation member 28. While shown with a cylindrical shape, it is contemplated that other geometries are available for the cylinder 26 and the rotation member 28. For example, the rotation member 28 may include a taper sized to match an interior surface of the cylinder 26 to create an interference fit therebetween. A lever 30 may direct rotation of the cylinder 26 and rotation member 28. For example, the cylinder 26 may define a first rack 34 sized for meshing with a second rack 36 defined by the lever 30. Movement of the lever 30 directs the cylinder 26 and rotation member 28 to rotate.

It is contemplated that additional structures are available for the rotation mechanism 22. For example, the rotation mechanism 22 may be motorized such that a user may press buttons to direct rotation of a motor in communication with the rotation member 28. Alternatively, handles (not shown) or knobs (not shown) may extend from the base 20 to direct movement thereof and such that a flexible nature of the housings themselves allow for adequate punching oscillations.

The rotation member 28 may define an aperture 40 sized to receive a portion of an expandable housing such as a balloon 42. For example, a lower portion of the balloon 42 may extend through the aperture 40 and then the balloon 42 may be inflated. Alternatively, the balloon 42 may be inflated prior to extending the lower portion through the aperture 40. The lower portion of the balloon 42 may be secured to one or more hooks 46 extending from the rotation member 28. In one example, the lower portion of the balloon 42 may be wrapped around the one or more hooks 46 to attach the balloon 42 to the rotation mechanism 22 or the base 20 such that the balloon 42 rotates therewith. The balloon 42 may be of a flexible material such as latex or other suitable material to accommodate a gas or liquid within the balloon 42.

A cap assembly 54 may be sized for mounting to the balloon 42. The cap assembly 54 may include an upper portion 56 and a band 58. One or more appendages 60 may be secured to the band 58. One or more straps 62 may extend from the upper portion 56 to the band 58. One of the straps 62 may include a member 64 defining a surface for including indicia or other markings such as a game title or face. The band 58 and the straps 62 may be arranged with one another to receive a portion of the balloon 42. For example, the band 58 and the straps 62 may be sized for positioning on the balloon 42 as a helmet. The band 58 may be of a flexible material with elastic characteristics to accommodate various sizes of the balloon 42. Alternatively, the cap assembly 54 may be a mesh structure of plastic or fabric. The positioning on the balloon 42 may be such that the band 58 and straps 62 are snug against the balloon 42 without popping or damaging the balloon 42. At least one of the straps 62 may include a feature, such as a vertical or horizontal rib (not shown), to assist in retaining the cap assembly 54 in position upon the balloon 42 and to assist in providing stability when the balloon 42 is rotated.

Each of the one or more appendages 60 may be an arm including a hand. Each of the hands may include a feature to puncture the balloon 42 of the opposite toy character. For example, each of the one or more appendages 60 may include one or more puncture surfaces 70. The puncture surfaces 70 may be oriented on the respective appendage 60 such that rotation of the rotation mechanism 22 directs movement of the puncture surfaces 70 to contact and puncture the balloon 42 of the opposing toy character. Examples of the puncture surface 70 include a sand paper segment, an emery board, a silica-based grit, an aluminum based grit, a breakaway lancet, a pin, or gnarled metal. Alternatively, each of the hands may define the puncture surface 70. Components of each of the toy characters, aside from the balloon 42, may be made of injection molded plastic such as acrylonitrile butadiene styrene (ABS), polypropylene (PP), polyethylene (PE), or nylon.

Figure 10A:
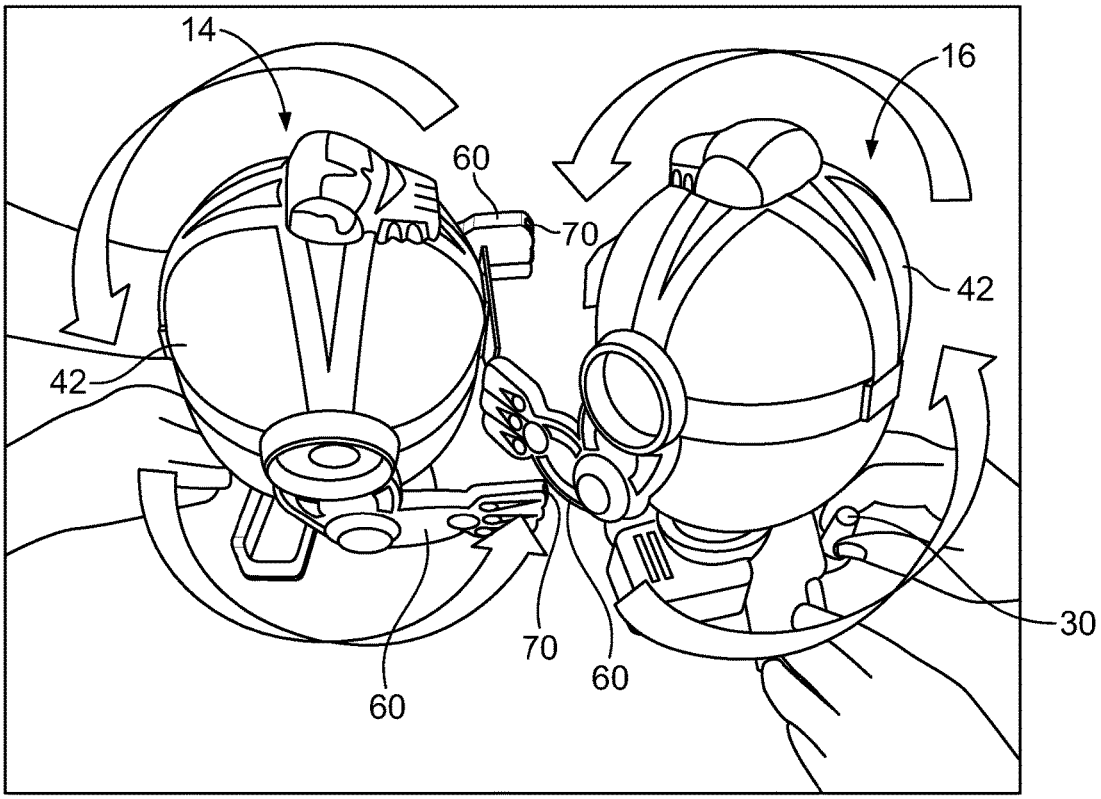
FIG. 10A is a perspective view of an example of a portion of a battle sequence between the first and second toy characters of FIG. 1.
Figure 10B:
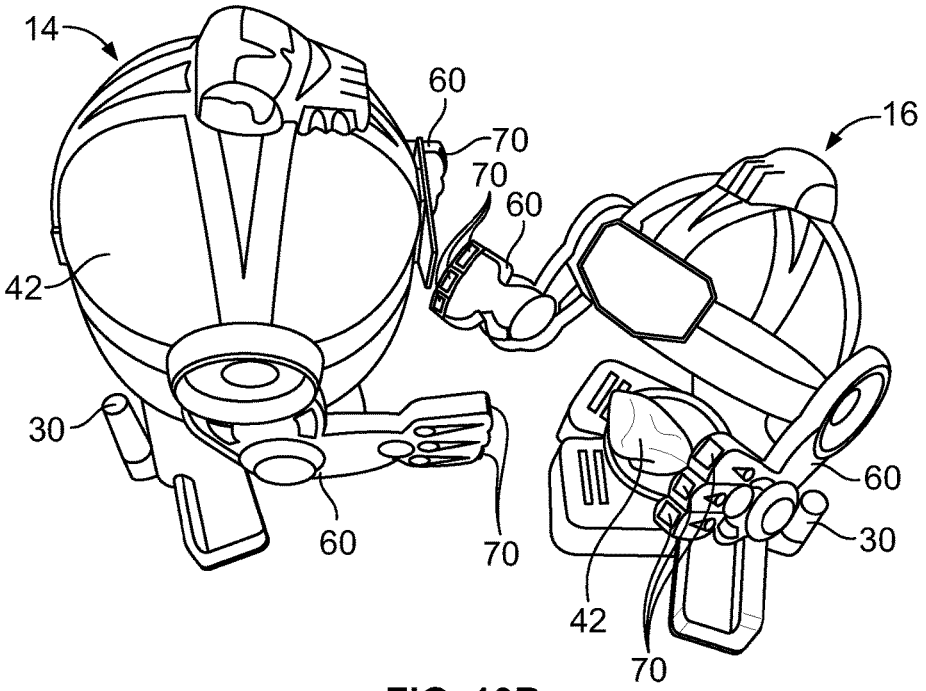
FIG. 10B is a perspective view of another example of a portion of a battle sequence between the first and second toy characters of FIG. 1.

FIGS. 10A and 10B show an example of portions of a battle sequence between the first toy character 14 and the second toy character 16. As mentioned above, users may position the first toy character 14 and the second toy character 16 upon an underlying surface for battle with one another. Each of the users may move the lever 30 of their respective toy character to rotate the appendages 60 back and forth as represented in FIG. 10A. FIG. 10B shows a portion of a battle sequence in which the first toy character 14 has a popped balloon 42 of the second toy character 16 following contact by the puncture surfaces 70 of one of the appendages 60 of the first toy character 14.

Figure 10E:
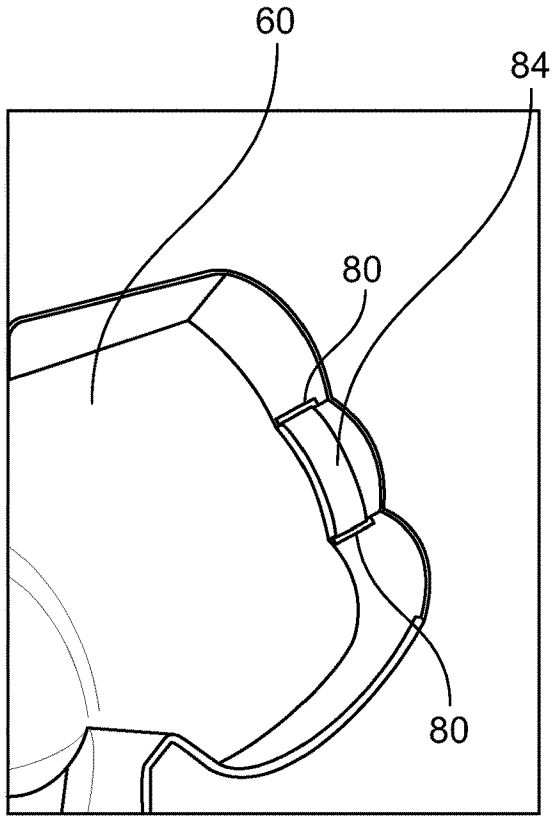
FIG. 10E is another perspective view of the example of slots of FIG. 10A showing ends of the sand paper strip secured to one another.
Figure 10D:
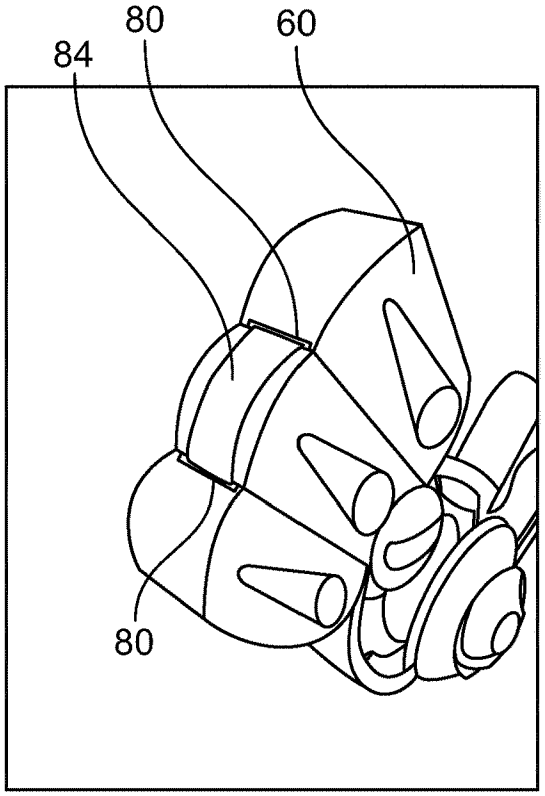
FIG. 10D is another perspective view of the example of slots of FIG. 10A showing a sand paper strip mounted via the slots.
Figure 10C:
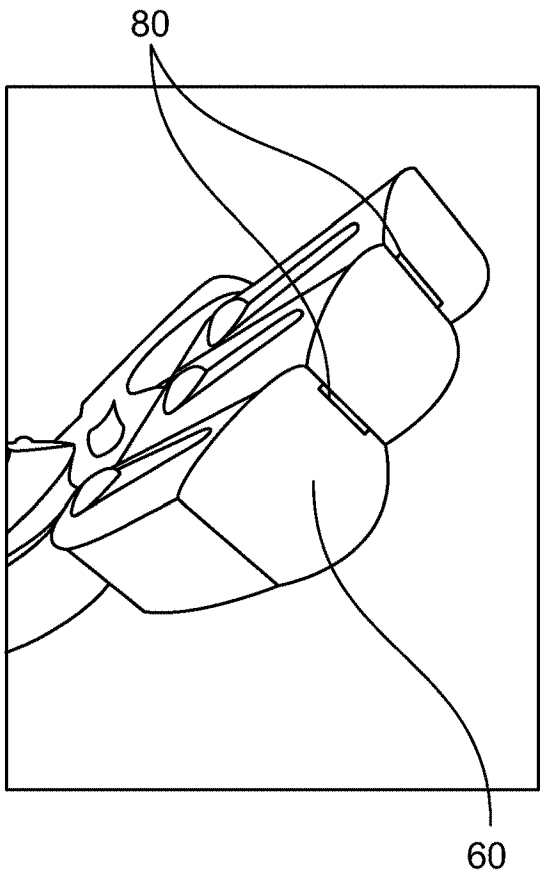
FIG. 10C is a perspective view of an example of slots which may be defined by an appendage of one of the toy characters of FIG. 1.

FIGS. 10C through 10E show an example of an attachment structure for the puncture surfaces 70. A pair of slots 80 may be defined by each of the appendages 60. The slots 80 may be spaced from one another and be sized to each receive a portion of a material piece, such as a sand paper strip 84. The sand paper strip 84 may extend through each of the slots 80 and opposite ends of the sand paper strip 84 may be secured to one another. The slots 80 may be oriented on the respective appendages 60 such that the sand paper strip 84 is in a position to contact the opposing toy character's balloon 42 when the respective cap assembly is moved.

Figure 11:
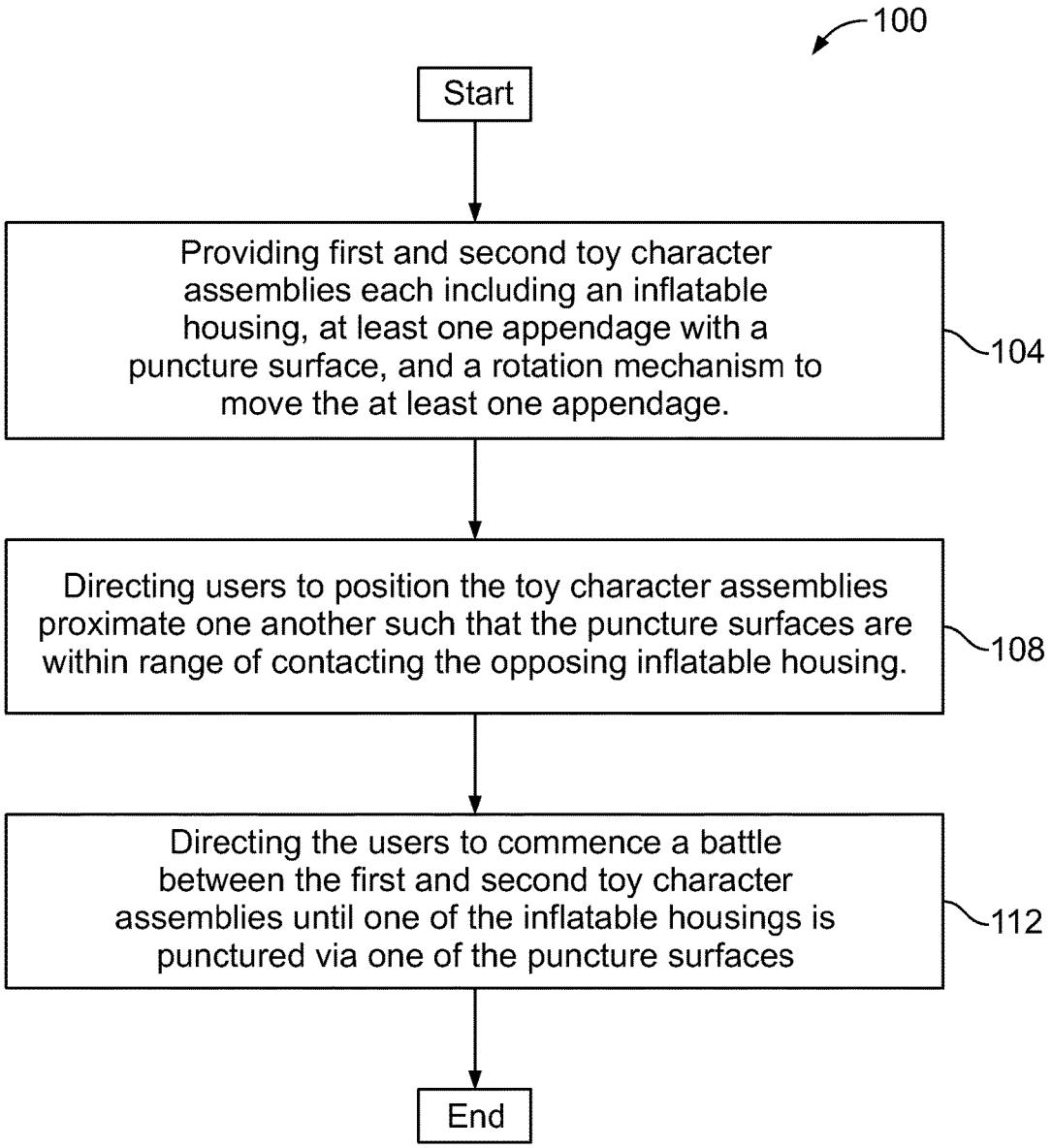
FIG. 11 is a flow chart showing an example of steps of a method of game play using the first and second toy characters of FIG. 1.

FIG. 11 shows an example of a method of game play generally indicated by reference numeral 100. In operation 104, a first and second toy character, such as the first toy character 14 and the second toy character 16, are provided. Each of the toy characters includes an assembly having an inflatable housing, at least one appendage with a puncture surface, and a rotation mechanism to move at least one appendage. In operation 108, the users are directed to position the toy characters proximate one another such that the puncture surfaces are in range for contact with the opposing toy character's inflatable housing. For example, a sheet of directions may include instructions for game play set up. In operation 112, the users may be directed to commence a battle sequence between the first and second toy characters. The users may rotate the rotation mechanism to swing the at least one appendage back and forth until one of the inflatable housings is punctured via one of the puncture surfaces.

It is contemplated that the toy characters may be shaped as various other characters. For example, the toy characters may have a medieval theme in which the appendages 60 include a medieval weapon, such as a ball and chain. In other examples, the toy characters may have an animal, robot, or alien theme and appropriate appendages in line with the theme. It is contemplated that the appendages 60 may be mounted to the band 58 for rotation or of a flexible material to provide for additional elements of play.

While various embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the disclosure that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to marketability, appearance, consistency, robustness, customer acceptability, reliability, accuracy, etc. As such, embodiments described as less desirable than other embodiments or prior art implementations with respect to one or more characteristics are not outside the scope of the disclosure and can be desirable for particular applications.

We claim:

1. A toy system for playing a battle-oriented game comprising:

a pair of toy characters, each of which includes a support structure defined to include:

a base;

an expandable housing;

a cap assembly including at least two straps and a band for securing the cap assembly around the expandable housing;

at least one movable appendage extending from the cap assembly, and the at least one movable appendage having an outwardly facing puncture surface and wherein the outwardly facing puncture surface is a strip of material extending through two slots defined by the at least one movable appendage; and a rotation mechanism mounted to the base and having a aperture sized to receive a portion of the expandable housing, the rotation mechanism further has a manual lever to direct rotational movement of the rotation mechanism about the base such that manually moving the lever cause the cap assembly to rotate about the base; and wherein the pair of toy characters are arranged against one another for a sparring sequence in which each toy characters are rotated until one of the puncture surfaces punctures one of the expandable housings.

2. The toy system of claim 1, wherein the rotation mechanism further includes a rotation member having one or more hooks located adjacent the receiving aperture for securing the expandable housing thereto.

3. The toy system of claim 2, wherein the rotation member is removeable from the base to provide access to the one or more hooks.

4. The toy system of claim 2, wherein the rotation mechanism further includes a rotation housing to support the rotation member and define a first rack, wherein the lever defines a second rack, and wherein the first rack and second rack are sized to mesh with one another so that movement of the second rack directs rotation of the rotation housing to rotate the expandable housing.

5. The toy system of claim 1, wherein the puncture surface comprises at least one of a sand paper segment, an emery board, a silica-based grit, an aluminum based grit, a breakaway lancet, a pin, and a portion of gnarled metal.

6. The support structure of claim 1, wherein the band IS expandable to accommodate more than one size of the expandable housing.

7. The toy system of claim 1, further comprising an indicia member extending from the cap assembly and including a surface sized for displaying indicia.

8. The toy system of claim 1, wherein the base and cap assembly are stylized to have one of a medieval theme, an animal theme, a robot theme, and an alien theme.

* * * * *